US006148493A

United States Patent [19]

Pixley et al.

[11] Patent Number: 6,148,493

[45] Date of Patent: Nov. 21, 2000

[54] POP RIVET CORE PUNCH

[76] Inventors: Harvey Pixley, 3801 Atlas Rd., Louisville, Ky. 40229; Merle Wernert, 2008 Spring Farms Dr., Floyds Knobs, Ind. 47119

[21] Appl. No.: 09/079,616

[22] Filed: May 15, 1998

[51] Int. Cl.[7] ..... B25B 27/14

[52] U.S. Cl. ..... 29/275; 29/278; 29/271

[58] Field of Search ..... 29/275, 278, 271, 29/243.53, 243.54, 34 R

[56] References Cited

U.S. PATENT DOCUMENTS

| | | | |
|---|---|---|---|
| 2,730,811 | 1/1956 | Gouldsmith | 29/34 R |
| 3,601,880 | 8/1971 | Brown | 29/200 |
| 3,685,126 | 8/1972 | Kane | 29/254 |
| 4,649,733 | 3/1987 | Gilmore | 72/479 |
| 4,852,231 | 8/1989 | Turner | 29/156.5 |
| 5,099,562 | 3/1992 | Loughman | 29/275 |
| 5,327,631 | 7/1994 | Lincavage | 29/271 |
| 5,558,323 | 9/1996 | LoFaso, Sr. | 237/1.5 A |

*Primary Examiner*—David A. Scherbel
*Assistant Examiner*—Lee Wilson
*Attorney, Agent, or Firm*—Joseph N. Breaux

[57] ABSTRACT

A pop rivet core punch which includes an alignment sleeve slidable mounted to an elongated punch shaft and springingly urged to extend over a core punching end of the elongated shaft while the sleeve aligns the core punching end with a center of the pop rivet and a handle end on the elongated shaft provides a mechanism for handling the punch and striking the punch with a hammer thereby forcing the spring to compress and pushing the core punching end past the sleeve and into the pop rivet center thereby removing the pop rivet core from the pop rivet, the pop rivet may then be quickly drilled and removed without damaging the surrounding material.

3 Claims, 3 Drawing Sheets

POP RIVET CORE PUNCH

TECHNICAL FIELD

The present invention relates to devices and methods for hole punches and more particularly to devices and methods for a pop rivet core punch which facilitates the removal of a pop rivet core thereby allowing the pop rivet to be quickly removed by drilling and furthermore providing a task specific tool for removal of pop rivets quickly and efficiently.

BACKGROUND ART

Although there has been numerous punches designed, and patented, there has never been a centering pop rivet core punch which is specifically designed for removal of a pop rivet core as the present invention. The usual method of removing pop rivets requires the worker to drill the center of the rivet removing enough rivet material so that the rivet shoulders separate from the rivet body. Drilling the center of pop rivets is complicated by the presence of a pop rivet core which is left behind in the center of the pop rivet in the installation process. The core is typically constructed of harder material then the rivet body, therefore attempts to drill the core, which is about 1/16 to about 1/4 inch in diameter, sometimes results in the drill bit wondering from the center of the core and removing material from the surrounding material. Removing the pop rivet core prior to drilling makes the drilling process precede very quickly and easily. The present invention provides a tool which solves these problems.

Punches for various applications are utilized throughout the prior art such as the punch exemplified in U.S. Pat. No. 5,327,631 to Lincavage, which discloses and claims a plurality of roll pin punches which are easily mounted to a handle and provided as a combination kit.

Loughran, U.S. Pat. No. 5,099,562 discloses a hinge pin and tip removal tool, which tool is utilized for removing the hinge pin from the hinge leaves.

Turner, U.S. Pat. No. 4,852,213 discloses a wrist pin removal device which is adaptable for use on a hydraulic ram and which is utilized for removal of wrist pins from a piston.

Gilmore, U.S. Pat. No. 4,649,733 discloses a punch for setting a rivet, which includes a sleeve slidingly carried by a shank while a spring urges the sleeve downwardly. This device is used for flattening a rivet in place, and not for removing a pop rivet as the present punch.

Kane, U.S. Pat. No. 3,685,126 discloses a tool for aligning holes through overlapping structural members which includes a stepped segment for insertion into holes of various sizes and a slidable impact member.

As can be seen, there continues to be a need for a new and job specific pop rivet core punch as set forth in the present invention which addresses the problem of removing pop rivets quickly and easily while exerting the least amount of forces to surrounding structural members. The present invention provides this need by providing a pop rivet core punch which includes an alignment sleeve slidable mounted to an elongated punch shaft and springingly urged to extend over a core punching end of the elongated shaft while the sleeve aligns the core punching end with the center of the pop rivet an enlarged handle end on the elongated shaft provides a means for handling the punch and striking the punch with a hammer thereby forcing the spring to compress and pushing the core punching shaft end past the sleeve area and into the pop rivet center thereby removing the pop rivet core from the pop rivet, the pop rivet may then be quickly drilled and removed without damaging the surrounding material.

GENERAL SUMMARY DISCUSSION OF INVENTION

The purpose of the present invention, which will be described in detail below, is to provide a job specific tool for removing pop rivet cores allowing a pop rivet to be quickly drilled and removed. The tool includes an elongated punch shaft having a core punching end with a hollow tubular shape sleeve slidably carried about the punch shaft and movable from a position protruding past the core punch end of the shaft to a position where the core punching end extends past the sleeve and into a pop rivet center thereby displacing the pop rivet core. A spring is mounted on the outside of a sleeve side wall and extends to a shaft shouldered shank area whereby the spring urges the alignment sleeve downwardly and is compressed by striking the end of the elongated shaft. The tool facilitates the removal of pop rivet cores and ultimately the pop rivet body by drilling.

It is thus an object of the invention to provide a Pop Rivet Core Punch that provides an efficient and quick means of removing a pop rivet core so that the pop rivet may be drilled and removed without damaging material held by the pop rivet.

It is a further object of the invention to provide a Pop Rivet Core Punch that is cost effectively and efficiently manufactured and marketed as a job specific tool for removal of pop rivet cores.

It is a still further object of the invention to provide a Pop Rivet Core Punch that centers an elongated core punching shaft over a pop rivet head while a sleeve springingly and slidably disposed on the end of such shaft provides an alignment means for directing the core punching end into the pop rivet center when the shaft is forced into the pop rivet and the spring compressed by the force exerted by a hammer. Accordingly, a pop rivet core punch is provided which includes a elongated shaft having a core punching end and a hammer striking end with a hollow tubular shape sleeve slidably positioned on the core punching end of the shaft and further wherein the sleeve has an internal diameter which snugly fits over a head of a rivet and provides a guide for the core punching end of the shaft, further wherein a spring is positioned between the slidable sleeve and a shouldered portion of the elongated shaft, whereby the spring urges the sleeve to extend over the core punching end of the shaft while the force exerted by a hammer striking end of the shaft causes the core punching end to extend beyond the sleeve and into the center of a pop rivet thereby displacing a pop rivet core and facilitating drilling and removal of the pop rivet.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that the pop rivet core punch is utilized for quickly and efficiently removing pop rivet cores so that a pop rivet can be quickly drilled and removed. The core punch automatically centers a core punching end over a pop rivet head so that the core punching end can be driven into the pop rivet center by striking the end of the punch with a hammer. A hollow sleeve which is slidably disposed upon the core punching end of the shaft acts as a centering device and is springingly bias to extend over the core punching end of the shaft allowing the tool to be centered over the head of a rivet prior to punching the center of the pop rivet. The core of the pop rivet is the portion of a pop rivet remaining in the center aperture of the pop rivet after it has been installed. The center core is constructed of harden steel and particularly difficult to drill and consequently causes the drill to wonder thereby inadvertently removing metal from the surrounding material held by the pop rivet. The present invention provides a means for removing the center core of the pop rivet so that the rivet body may be drilled quickly without damaging surrounding material.

Figure 1:
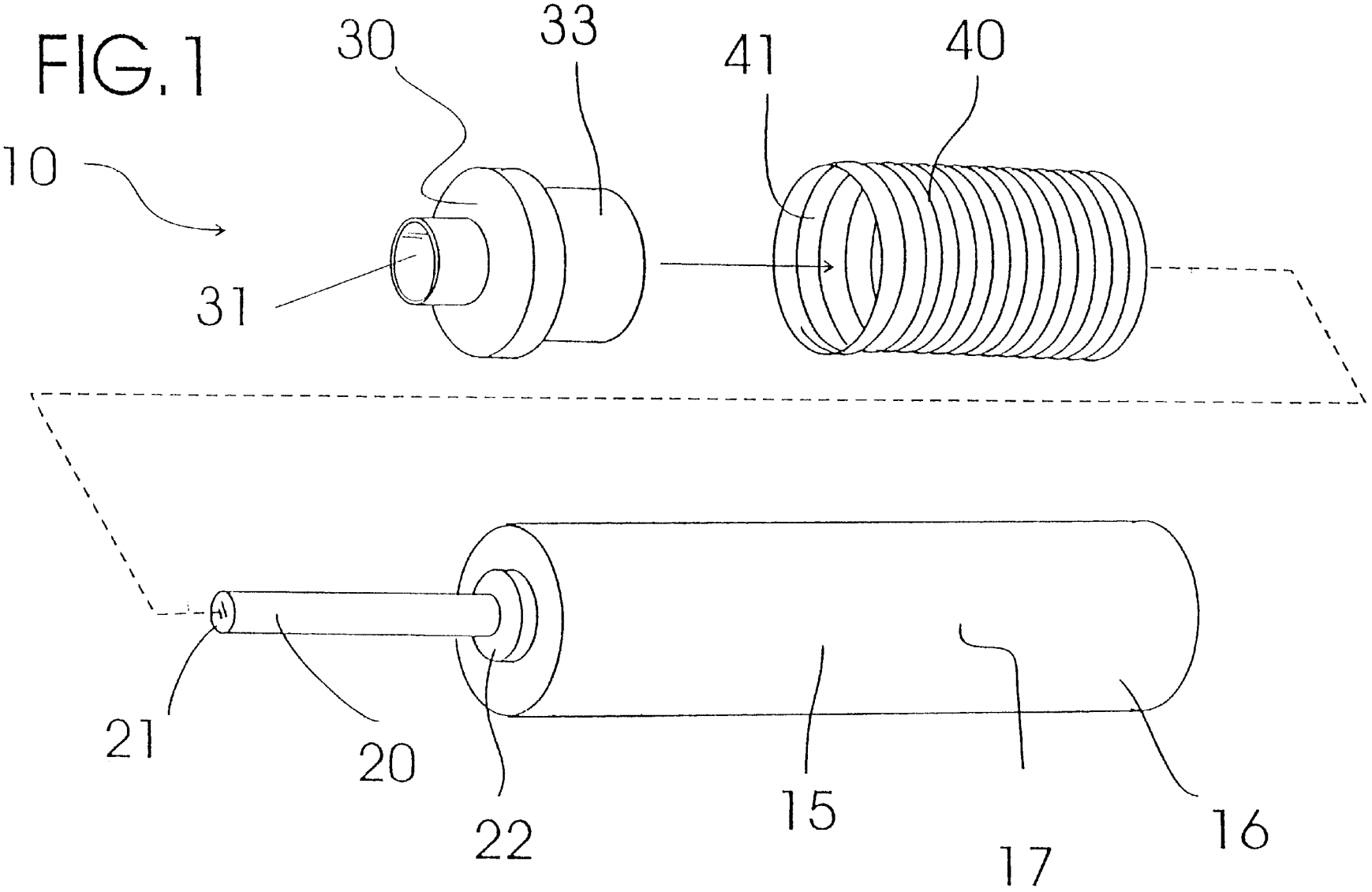
FIG. 1 is an exploded view of the pop rivet core punch illustrating the shouldered sleeve, springs, and punch body along with the elongated shaft.
Figure 2:
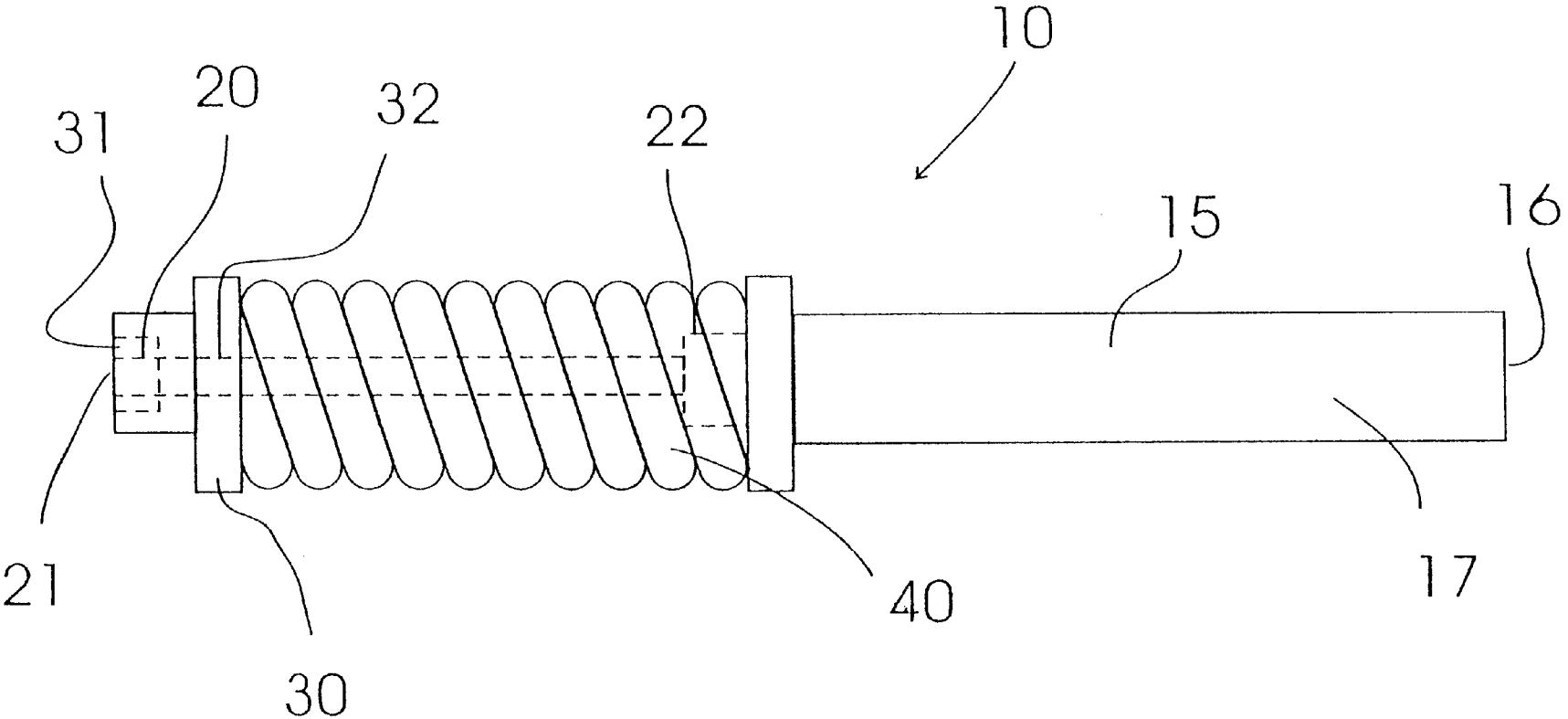
FIG. 2 is a side view of an assembled pop rivet core punch.
Figure 3:
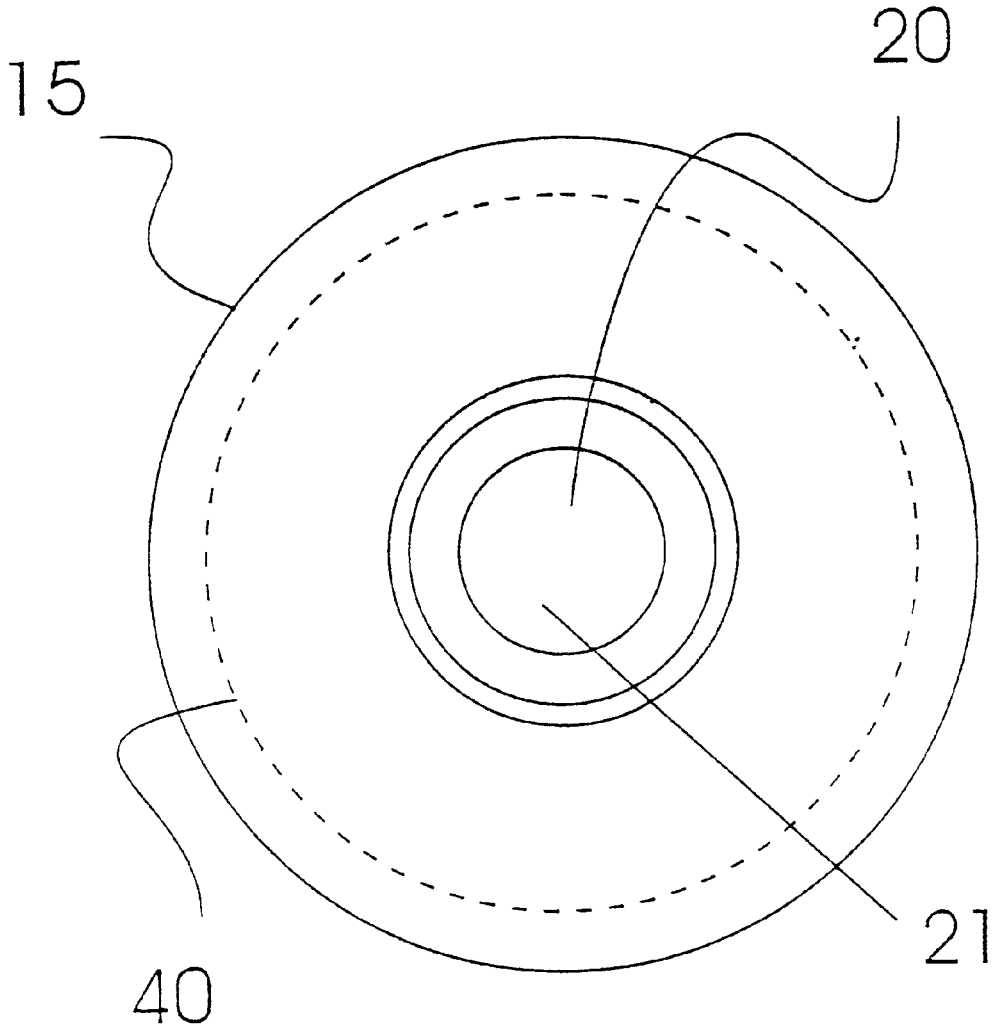
FIG. 3 is an end view of the core punching end of the pop rivet core punch.

Referring to the drawings in detail FIG. 1 illustrated an exploded view of the pop rivet core punch 10 which comprises a punch body 15, a punch shaft 20, a centering sleeve 30 and spring 40.

The punch body 15 and shaft 20 are preferably constructed of a single piece of hardened steel. The punch body 15 includes a striking end 16 which provides a means for striking the punch with a hammer. The punch body 15 also includes a handle means 17 which provides a means for gripping the core punch when in use. The surface of the handle area 17 may also include a textured surface such as a knurled surface for providing effective gripping of the device when in use. The shaft 20 extends from the punch body 15 and is elongated for extending through spring 40 while slidingly receiving centering sleeve 30 upon the shaft 20. The shaft 20 includes a core punching end 21 and a shouldered portion 22. The shouldered portion 22 provides a spring mounting means and which shoulder 22 diameter is dimensioned to tightly receive an inside diameter 41 of spring 40. The entire length of the punch body is about six to eight inches long while it has a diameter of about one half inch.

Centering sleeve 30 includes a central centering aperture 31 which has an internal diameter slightly larger than the outside diameter of a rivet head while the central centering aperture 31 provides a means for centering the core punching end 21 over the head of the rivet. The centering sleeve 30 also has a punch shaft aperture 32 extending through the centering sleeve 30 providing a means for slidably mounting the centering sleeve 30 to the elongated shaft 20. The centering shaft 30 also comprises a shoulders spring mount 33 which has an outside diameter about the same as the spring interior diameter 41 and provides a means for mounting the centering sleeve 30 on the spring 40. The spring 40 is biased to springingly prevent movement of the centering sleeve 30 toward the shouldered mount 22, while the spring 40 length positions the centering sleeve 30 beyond the core punching end 21 so that the core punching end 21 extends beyond the centering sleeve 30 when the spring 40 is compressed and the centering sleeve 30 slides up the elongated punch shaft 20. The core punching end must also extend far enough beyond the centering sleeve 30 and into a pop rivet center to contact and displace the pop rivet core.

The tool provides a quick means for preparing a pop rivet to be drilled and removed and as such is particularly useful for technicians who spend time removing rivets on a daily basis.

It is noted that the embodiment of the Pop Rivet Core Punch described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A Pop Rivet Core Punch comprising:

a punch body which includes a hammer striking end, an elongated punch shaft extending from said punch body opposite from said hammer striking end, wherein said elongated punch shaft comprises a core punching end and a shouldered spring mounting portion abutting the punch body, a centering sleeve with a shallow central centering aperture, with an inside diameter about equal to an outside diameter of a pop rivet head, the centering sleeve further comprising a central aperture extending from a central location of a bottom of the shallow central centering aperture and through the centering sleeve and further having a diameter that allows the sleeve to freely slide on the elongated shaft thereby providing a means for slidably mounting the centering sleeve on the elongated shaft so that the elongated shaft extends through the centering sleeve when sleeve is slid down the shaft, the centering sleeve further comprising a spring mounting shoulder with an outside diameter about equal to an inside diameter of a spring further wherein said spring mounting shoulder is positioned on the centering sleeve on an opposite side than the centering aperture, a spring positioned around the elongated shaft and between the centering sleeve spring mounting shoulder and the shouldered spring mounting portion wherein the spring is biased to resist sliding centering sleeve motion along the elongated shaft toward the shouldered spring mounting portion and further when the centering sleeve is placed over a pop rivet head with a core to be removed the core punching end of the elongated shaft moves into a pop rivet center when a user strikes the hammer striking end thereby overcoming a spring biasing force and causing the centering sleeve to move toward the spring shouldered mounting portion thereby causing the core punching end to extend beyond the centering sleeve and into the pop rivet center further thereby displacing a pop rivet core, the shouldered spring mounting portion having a diameter selected such that the shouldered spring mounting portion is tightly received and held within an end of the spring.

2. The Pop Rivet Core Punch of claim 1, wherein said punch body further comprises a handle portion.

3. The Pop Rivet Core Punch of claim 1, wherein the punch body and the elongated shaft are constructed of a single piece of hardened steel.

* * * * *